US005221351A

United States Patent [19]

Esser et al.

[11] Patent Number: 5,221,351

[45] Date of Patent: Jun. 22, 1993

[54] CONTROL DEVICE FOR OPERATING A COATING DEVICE

[75] Inventors: Reinhard Esser; Helmut Graab, both of Bergisch-Gladbach; Claus Martin, Hennef/Sieg, all of Fed. Rep. of Germany

[73] Assignee: Zanders Feinpapiere AG, Fed. Rep. of Germany

[21] Appl. No.: 612,114

[22] Filed: Nov. 9, 1990

[30] Foreign Application Priority Data

Nov. 9, 1989 [DE] Fed. Rep. of Germany ..... 3937322

[51] Int. Cl.[5] ..... B05C 11/04

[52] U.S. Cl. ..... 118/712; 118/663; 118/261; 118/413; 118/419; 427/8; 427/356; 340/689

[58] Field of Search ..... 118/663, 712, 126, 261, 118/413, 419; 427/8, 356; 162/281; 15/256.51; 101/162, 425; 100/174; 340/689

[56] References Cited

U.S. PATENT DOCUMENTS

| | | | |
|---|---|---|---|
| 4,755,806 | 7/1988 | Villarreal | 340/689 |
| 4,880,672 | 11/1989 | Ericksson | 118/413 |
| 4,884,067 | 11/1989 | Nordholm et al. | 340/689 |
| 4,906,335 | 3/1990 | Goodnow et al. | 118/261 |
| 4,907,529 | 3/1990 | Mannio | 118/126 |
| 4,919,756 | 4/1990 | Sawdai | 162/281 |
| 4,943,158 | 7/1990 | Pertl et al. | 340/689 |
| 4,966,093 | 10/1990 | Sommer | 118/413 |

FOREIGN PATENT DOCUMENTS

| | | | |
|---|---|---|---|
| 2555669 | 6/1977 | Fed. Rep. of Germany | 118/126 |
| 595552 | 9/1958 | Italy . | |

*Primary Examiner*—W. Gary Jones
*Assistant Examiner*—Todd J. Burns
*Attorney, Agent, or Firm*—Baker & Daniels

[57] ABSTRACT

A process for operating a coating device provides for capturing variations of the angle of the coating edge of a doctor element, for instance in relation to the horizontal, directly by a signal generator attached to the doctor element in the vicinity of its coating edge. This signal generator may work on electromagnetic basis so that the signal will be transmitted to a receiver without any line. Preferably a tilt switch is provided which determines slight variations of a set angle of the coating edge relative to, for example, the horizontal by means of displacement of a mercury pearl and two electrodes which will be short-circuited by the mercury pearl. Other embodiments can include a laser or LED as a signal source and a CCD camera as a receiver, or an ultrasound source can be used as a signal generator.

14 Claims, 3 Drawing Sheets

CONTROL DEVICE FOR OPERATING A COATING DEVICE

BACKGROUND OF THE INVENTION

The invention concerns a process for operating a coating device and suitable setups therefor.

With the measuring device described hereafter it is possible to examine the setting accuracy of blade coaters and to measure the movements of the coating blade under production conditions. This allows setting up a closed-loop control system for the blade coater so that under all operating conditions—blade wear, influence of the backing roll, pressure from the coating ink on the blade—the predetermined set angle of the blade can be retained accurately. This angular constancy of the blade, at its tip, is the most important basic requirement for maintaining a constant coating quality and coating amount.

Prior blade coater designs solve this problem with varying accuracy. However, the dynamic effects lead to variations of the blade angle. These are jointed by angular variations caused by blade wear.

SUMMARY OF THE INVENTION

An objective of the present invention is to capture and compensate for all changes of the blade angle. Using the measuring device described hereafter it is possible to accurately measure a desired set angle and maintain it under all operating conditions by way of a control. Since for that reason it is not longer necessary to exactly know the bending line of the blade and design the blade coater allowing for kinematics (in order to more or less exactly maintain the set angle, where all interferences may lead to larger variations), options are now available that were not previously realizable for the design of new blade coaters.

BRIEF DESCRIPTION OF THE DRAWINGS

The invention will be explained hereafter with the aid of the embodiments illustrated, in principle, in the figures.

DESCRIPTION OF THE PREFERRED EMBODIMENT

Figure 1:
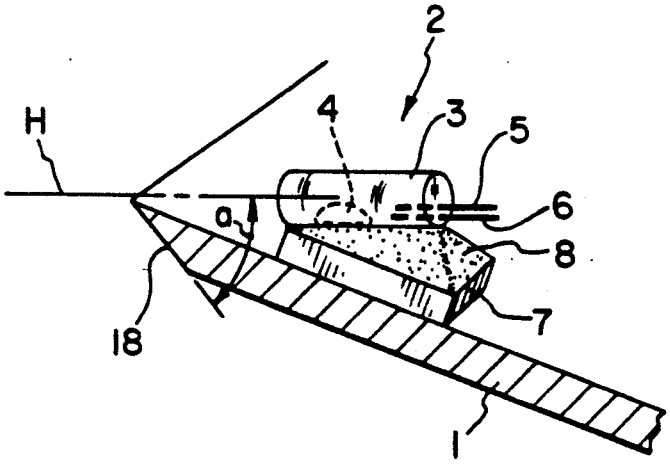
FIG. 1 shows a sectional view of the doctor element, wherein the signal element and magnet are shown in perspective.

In FIG. 1 of the drawings the doctor element, fashioned customarily as a coating blade, is marked 1 and its coating edge, by means of which it strips the coating substance and doses it, is marked 18. An angle a to a horizontal line H of the coating edge 18 is given. A signal element or transmitter, such as tilt switch 2 shown in FIG. 1, serves to capture this angle or deviations from this angle. This switch consists of a glass flask 3 which contains a mercury pearl 4. Two parallel wire electrodes 5 and 6 having approximately the same length are introduced in the glass flask. In case of a variation of the coating blade in its area near the coating edge 18, the tilt switch 2 will deviate from the exact horizontal position causing the mercury pearl to move either toward the two electrodes or away from them. If in this case the angle a increases, the mercury pearl moves toward the two electrodes 5, 6, of which one is the anode and other the cathode. The electrical circuit is closed this way and a signal is issued. In order to enable the capture of both directions of angular deviations, tilt switches must be provided also in reverse installation, that is, with a different direction of the two electrodes 5, 6. Alternating in their distribution, tilt switches can be provided across the length of the coating blade 1 with electrodes in both directions.

In the embodiment shown in FIG. 1, the tilt switches are attached with adhesives 8 to the permanent magnet 7, which then clings in a simple manner to the metallic coating blade. As known, such coating blades are made from spring steel.

Figure 2:
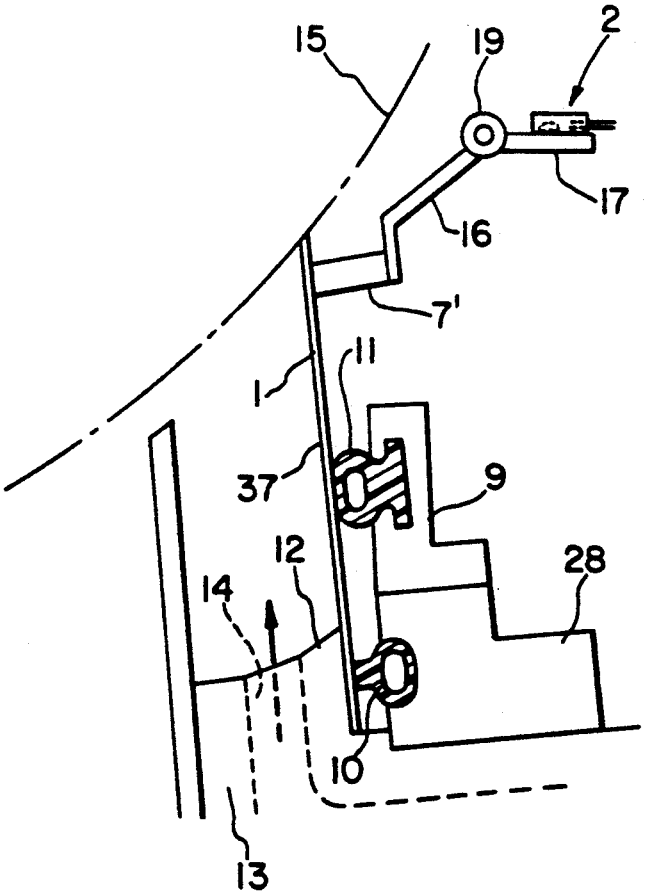
FIG. 2 shows a side elevational view, partially in section, of a coating device according to an embodiment of the present invention.

Illustrated in FIG. 2 is a section of a coating device in which a blade of the type illustrated in FIG. 1 is installed. The backing roll on which the coating blade 1 can be forced down by means of a pressure hose 11 is marked by a dash-dot line 15. The pneumatic pressure hose 11 is retained in a bracket 9 mounted on a support beam 28 which supports the entire coating device. The coating blade 1 is forced on a backing part 12 by means of another pneumatic pressure hose 10. Between the backing part 12 and the front wall 13 is a mouth 14 for a coating substance. The coating substance may be applied either directly on backing roll 15, or on a paper web supported by it, and then stripped by the coating edge of the blade 1. In one embodiment of the invention, the coating substance may be applied directly on the backing roll, and thereafter transferred to the web by the contact of the web and backing roll whereby the coating substance is squeezed therebetween.

In this case, the tilt switch 2 is mounted on a holder frame whose angle is adjustable and which features intermediate carriers, such as arms 16 and 17 that can be mutually adjusted in their angle and of which the one arm 16 is mounted on a permanent magnet 7, The angular position of the arm 17, and thus also of the tilt switch 2, relative to the arm 16 is adjusted by means of a joint 19, which preferably may be designed so as to be lockable. This setting may previously be made at the laboratory for every approach angle a of the coating edge 18 of the blade 1, then simply attaching the entire signaling device on the blade 1 by means of the permanent magnet 7'. This device also is favorable for especially close space conditions in the area of the coating edge 18 of the coating blade 1.

Also suitable are signal emitters other than the illustrated tilt switch. Specifically it is also conceivable to utilize lasers whose signal can be registered by a row of photoelectric diodes according to the angular position of the laser beam. Also conceivable are signal emitters other than on electromagnetic or acoustical basis.

A simple capturing element would be a pointer fastened to the coating blade. Other carrier elements or support devices attached to or remote from the doctor element or support device may similarly be used. A sleeve, such as a glass flask, with an electrolyte fluid could be used as a tilt switch, closing an electric circuit as well through electrodes.

Also suitable are magnetic fluids or magnetic solid bodies. In this case, the movement is measured by means of diodes or Hall probes.

Figure 3:
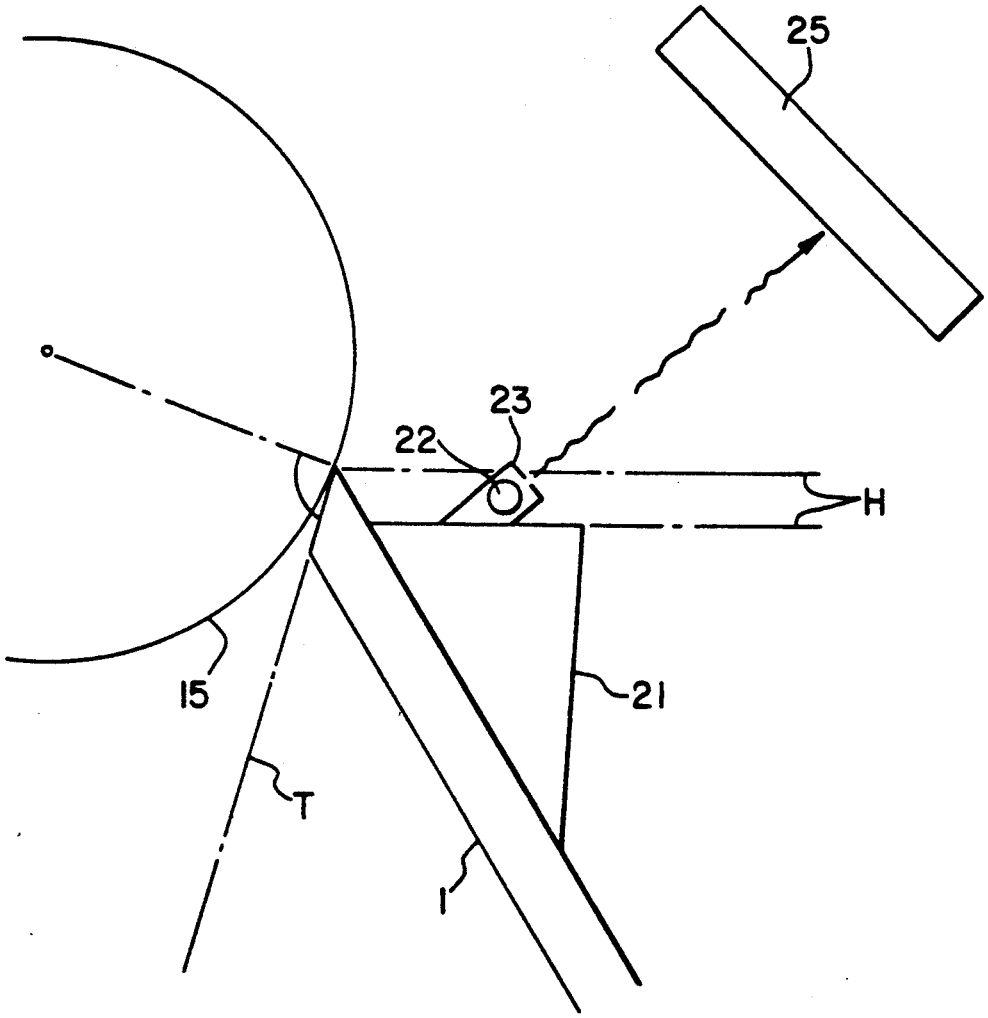
FIG. 3 shows a side elevational view of another embodiment of the present invention.

Illustrated in FIG. 3 is a setup where a light-emitting diode 22 in a cover 23 is attached to an angular part 21. The light emitting through a slit in the cover, facultatively bundled by a lens system, is captured by, for example, a diode array 25 or a CCD camera. The output signal of these devices is then processed in appropriate manner. The angular part 21 may be, for example, a ferromagnetic, magnetized material that will adhere to the metallic leaf spring (blade) 1. Its corner angle in the area of the coating blade 1 can be dimensioned according to the specified positions of the horizontal H and the tangent T at the point of contact of the coating surface on the backing roll 15. The light of this diode, or of a laser, may be used also as a light pointer or its intensity variations that occur at changed blade angle in a light receiver, such as a photodiode, can be used as a signal.

Figure 4:
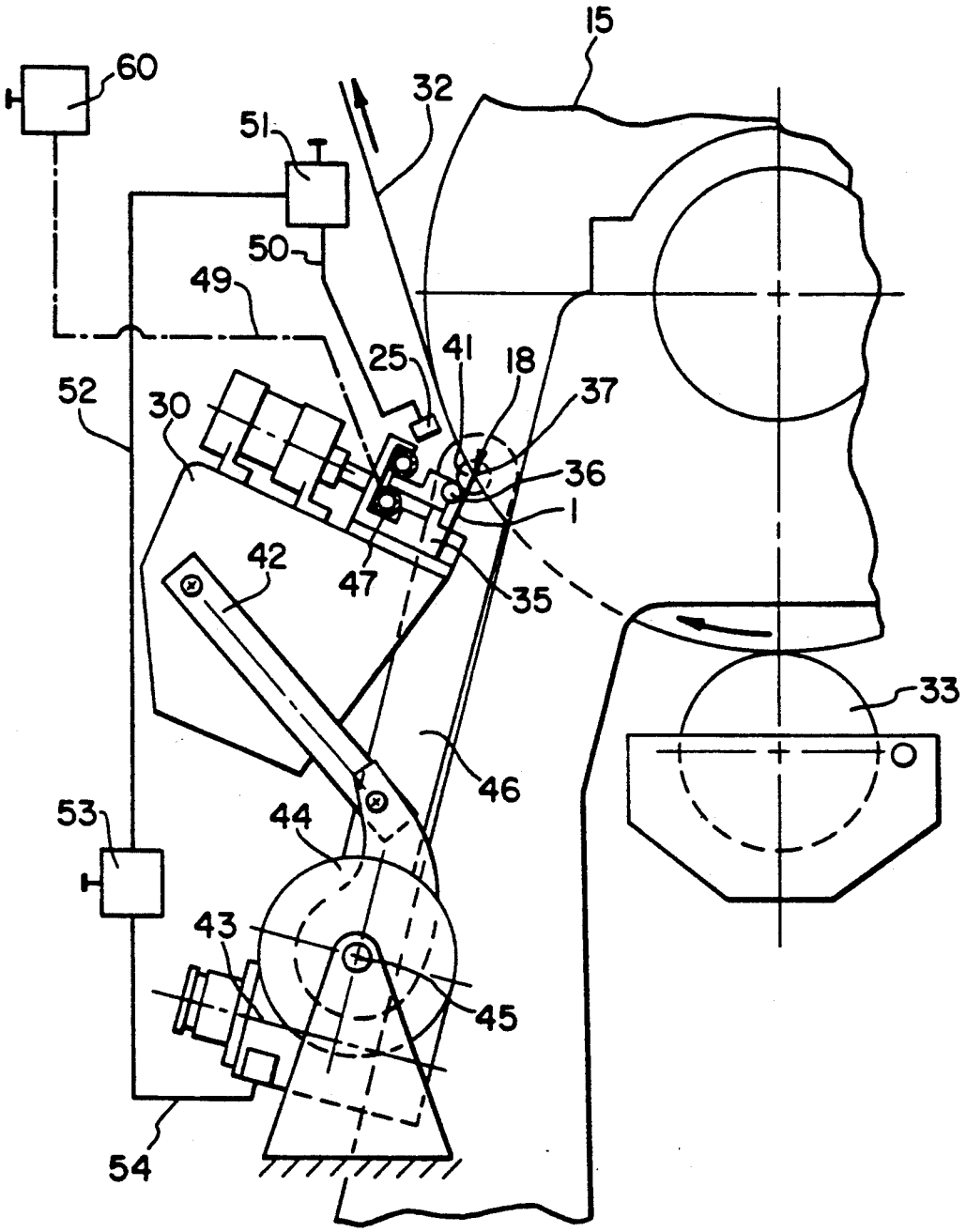
FIG. 4 shows a side elevational view of a further embodiment of the present invention, showing certain elements schematically.

FIG. 4 shows a backing roll 15 around which runs a paper web 32. An applicator roll 33 applies coating substance to the web 32. A scraper blade 1 strips excess coating substance. It is retained by a blade holder 35 while a bar-shaped contact element 36 pushes down on the latter, so that free blade end 37 will be forced into the coating substance on the web 32. The free blade end 37 is on its front provided with a blade spreading surface 18, which in the running direction of the web extends essentially parallel to the web surface. This can be seen from FIGS. 2 and 3.

The blade holder 35 is installed on a beam carrier 30 and pivotable with it about an axle 41, the pivot axis of which, viewed in lateral elevation, essentially aligns with the front spreading surface 18 of the blade. The pivotal displacement takes place by way of a linkage element 42 through a motor 43 with a transmission 44. The motor 43 with the transmission 44 and the blade holder 35 are mounted on an additional pivot axle 45 and can be pivoted away from the backing roll 15, together, about this pivot axle 45. For that purpose, the one end of the pivoting lever 46 is attached to the pivot axle 45 while its other end supports the aforementioned pivot axle 41.

The force exerted by the contact element 36 on the scraper blade 1 derives from the pressure difference between two compressed gas hoses 47. The pressure difference is adjusted by a pressure difference measuring instrument via a hose 49, controlled by a control mechanism 60. The signal pickup or receiver 25 transmits via a line 50 a signal corresponding to the current angular position of the coating blade 1 to a signal processing device 51; the output signal of the latter proceeds through a line 52 to a control 53 which in contingence on the measured angular variations transmits via a line 54 appropriate adjustment signals to the servomotor 43. The signals of the current angular position can also be transmitted by way of electromagnetic, acoustic, or light radiation. In response, the motor 43 pivots the blade holder 35 about the pivot axle in such a way that the front spreading surface 18 of the blade will always be parallel to the web surface, viewed in the running direction of the web 32, even at changes of the contact pressure. The center line of the pivot axle 41 is essentially in alignment with the front spreading surface 18 of the blade.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A control device for maintaining a coating edge of a coating device for coating a backing roll or a web supported by a backing roll at a fixed angular position in relation to said backing roll, said coating device including a doctor element having a working area which includes said coating edge, wherein said coating edge is forced down on said roll or web for smoothing and dosing a coating substance thereon, said doctor element being generally lath-shaped, or with spring elasticity in at least a portion of said doctor element wherein said element is mounted in a support device, said control device comprising:

a transmitting device for transmitting signals corresponding to the angular position of the coating edge, or to deviations of said angular position from a set value, to a receiver; said signals being transmittable from said transmitting device to said receiver by way of electromagnetic acoustic or light radiation, one of said transmitting device and said receiver being attached directly to said doctor element or indirectly by way of intermediate carriers; the other of said transmitting device and said receiver being connected directly to said support device or indirectly by way of carrier elements or any other support device detached or remote from said doctor element or support device; whereby said angular position of the coating edge is controlled by means of said signals.

2. A control device according to claim 1, wherein said transmitting device is attached directly to said doctor element.

3. A control device according to claim 1, wherein said transmitting device is attached to said doctor element indirectly by way of intermediate carriers.

4. A control device according to claim 1, in which one of a plurality of transmitters or a plurality of receivers is distributed along the coating edge of the doctor element, and wherein a local control of the contact force exerted by the coating edge is effected in contingence on the transmitted signals.

5. A coating device for coating a backing roll or a web supported by a backing roll, comprising:

a doctor element having a working area including a coating edge for smoothing and dosing a coating substance on the web, said doctor element being generally lath-shaped, or with spring elasticity in at least a portion of said doctor element supported by a support device; and a control device for keeping the coating edge at a fixed angular position in relation to said backing roll, said control device including at least one signal element for transmitting signals corresponding to said angular position of the coating edge, or to deviations of said angular position from said fixed position, to at least one receiver; said signal element being attached directly to said doctor element in the vicinity of the coating edge, or indirectly by way of intermediate carriers in the immediate vicinity of the coating edge; the other of said receiver being connected directly to said support device, or indirectly by way of carrier elements or any other support device detached or remote from said support device or doctor element; said signal element comprising one of a tilt switch, a light-emitting diode, a laser, and an ultrasound source, and fastened on said doctor element in the immediate vicinity of said coating edge; whereby said angular position of the coating edge is controlled by said signals.

6. A coating device according to claim 5, wherein said signal element is held on the doctor element by means of a permanent magnet.

7. A coating device according to claim 6, wherein the signal element is fastened on said doctor element by way of a holder that permits angular adjustment.

8. A coating device according to claim 5, wherein said signal element is operatively associated with said doctor element by way of a beam fashioned as a leaf spring, or through the intermediary of a holder device.

9. A coating device according to claim 8, wherein the signal element is fastened on said beam by way of a holder that permits angular adjustment.

10. A coating device according to claim 5, wherein an angular part fastens the signal element.

11. A coating device according to claim 10, wherein said angular apart is magnetic.

12. A coating device according to claim 5, in which the signal element comprises a light-emitting diode, wherein said diode has a light intensity that is varied in relation to the receiver according to the inclination of the doctor element through an aperture, said aperture being immovably arranged relative to the doctor element.

13. A coating device according to claim 5, wherein the receiver comprises a diode array and wherein the signal element comprises one of a light-emitting diode and a laser.

14. A coating device according to claim 5, wherein the receiver comprises a CCD camera and wherein the signal element comprises one of a light-emitting diode and a laser.

* * * * *

UNITED STATES PATENT AND TRADEMARK OFFICE

CERTIFICATE OF CORRECTION

PATENT NO. : 5,221,351

DATED : June 22, 1993

INVENTOR(S) : Reinhard Esser, et al.

It is certified that error appears in the above-identified patent and that said Letters Patent is hereby corrected as shown below:

Column 4, claim 5, line 64, delete "the other of";

Column 6, claim 10, line 2, after "element", insert --to the doctor element--; and Column 6, claim 11, line 4, replace "apart" with --part--.

Signed and Sealed this

Twenty-sixth Day of April, 1994

Bruce Lehman

*Attest:*

BRUCE LEHMAN

*Attesting Officer*

*Commissioner of Patents and Trademarks*